United States Patent [19]

Leyendecker

[11] 4,074,164

[45] Feb. 14, 1978

[54] SUN LAMP

[75] Inventor: Helmut Leyendecker, Taufkirchen, Germany

[73] Assignee: Patent-Treuhand-Gesellschaft fur Elektrische Gluhlampen mbH, Munich, Germany

[21] Appl. No.: 780,980

[22] Filed: Mar. 24, 1977

[30] Foreign Application Priority Data

Apr. 15, 1976 Germany ..... 2616893

[51] Int. Cl.[2] ..... H01J 61/34; H01J 61/40; H01J 61/20

[52] U.S. Cl. ..... 313/25; 313/111; 313/112; 313/229

[58] Field of Search ..... 313/25, 184, 229, 111, 313/112, 113

[56] References Cited

U.S. PATENT DOCUMENTS

| | | | |
|---|---|---|---|
| 2,524,455 | 10/1950 | Macksoud | 313/111 X |
| 3,093,769 | 6/1963 | Kuhl et al. | 313/25 X |
| 3,590,307 | 6/1971 | Dobrusskin et al. | 313/184 X |
| 3,842,307 | 10/1974 | Dobrusskin et al. | 313/229 X |

OTHER PUBLICATIONS

"High Pressure Mercury Vapour Lamps and their applications" by W. Elenbaas et al., 1965, pp. 215–221.
"Materials and Techniques for Electron Tubes" by W. H. Kohl, 1966, pp. 22, 23, 606, 608, 609.
"Mercury Lamps", one page of G.E. Flyer, Jan. 1963, FIG. 8–RS Sunlamp.

*Primary Examiner*—Palmer C. Demeo
*Attorney, Agent, or Firm*—Flynn & Frishauf

[57] ABSTRACT

A sun lamp comprising an arc tube integrally mounted in an envelope transmissive to UV-radiation. The arc tube is of the halogen metal vapor discharge lamp type and contains mercury, together with (i) at least one rare earth metal halide or (ii) iron halide. The light transmissive envelope comprises a glass which transmits large amounts of the UV-A component of ultraviolet radiation, and transmits substantially no UV-C component of the radiation. The ratio of transmitted UV-A to UV-B is similar to that in natural radiation.

10 Claims, 1 Drawing Figure

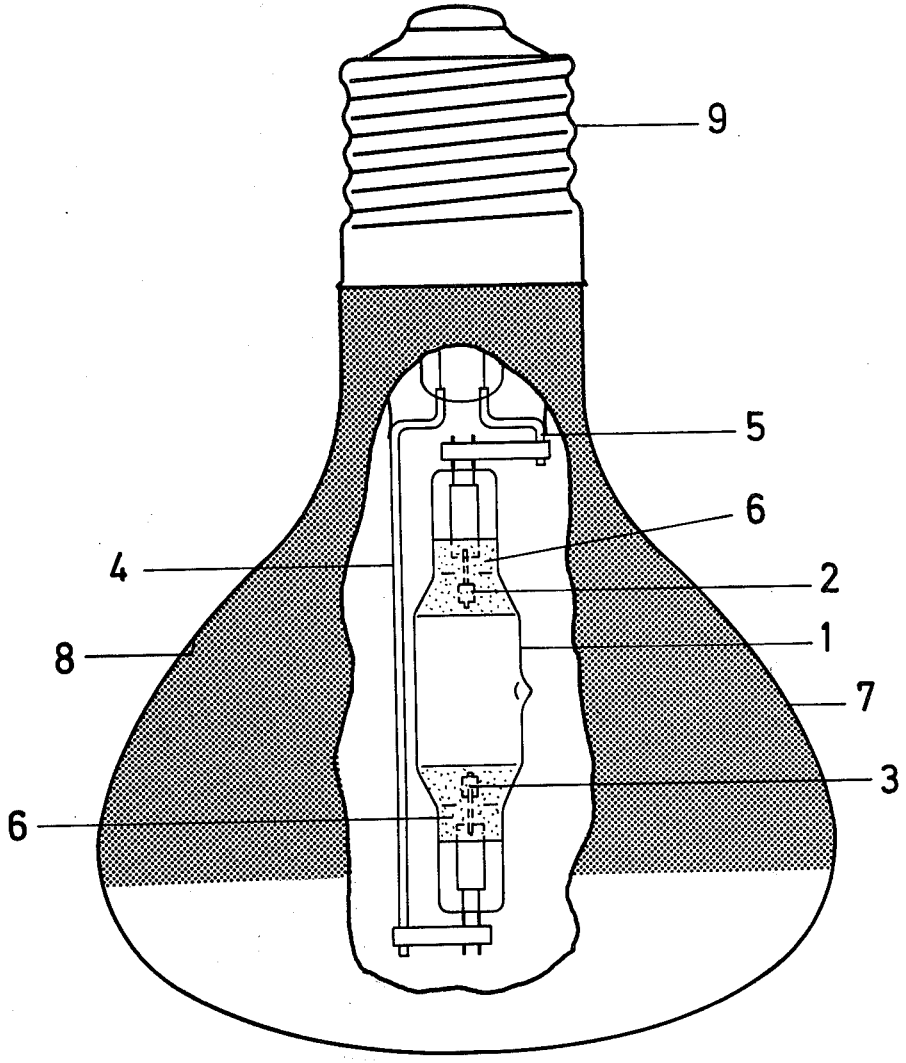
9
5
6
4
2
8
1
7
3
6

SUN LAMP

The invention relates to an irradiation lamp, i.e., a sun lamp, having an arc tube mounted in an encompassing bulb which is transmissive to ultraviolet radiation and forms, together with the arc tube, a structural unit. The arc tube comprises a tubular vessel filled with gas with electrodes hermetically sealed in opposite ends thereof. The gas permits initiation of an electric discharge between the electrodes.

The ratio of emitted radiation in the UV-A region (380 - 315 nm), UV-B region (315 - 280 nm) and UV-C region (< 280 nm) is of particular importance in irradiation lamps emitting in the ultraviolet region of the spectrum intended to function as sun lamps. For example, skin tanning is attained either by direct pigmentation with UV-A radiation or, by secondary pigmentation following a preceding development of erythema with UV-B radiation. The share of UV-C radiation shall be kept as low as possible because of its conjunctivitis-producing effect. It is desirable to attain a radiant distribution resembling that of natural daylight radiation, i.e. a high UV-A component and as little UV-C radiation as possible relative to UV-B radiation.

In known irradiation lamps having a mercury arc tube without an outer envelope, a high UV-C radiation component is produced. The use of lighting fixtures is required which are closed off by a special filter glass in order to correct the radiant distribution (GB-PS 813 118). Irradiation lamps also are shown which comprise arc tubes filled with mercury and mounted in UV-transmissive glass envelopes of special design. The arc tube is surrounded by a filament. The arc tube together with the envelope forms a structural unit (DT-PS 725 396). In these irradiation lamps the UV-C component of radiation is extremely low; however, the erythema-developing UV-B radiation is relatively high, compared with the UV-A radiation causing pigmentation. Likewise known in the art is the use of a halogen metal vapor arc tube for irradiation purposes which is closely surrounded by a tubular envelope of quartz glass. These lamps are of high output in the UV-A region, but due to the large amount of UV-C radiation transmitted through the quartz glass, they are enclosed with special closure glasses in lighting fixtures (DT-GM 7 324 163). With these assemblies it is impossible though, to filter out sufficient of the UV-C component without impairing the desired transmission of the other radiation components.

It is the aim of the present invention to provide a handy irradiation (sun) lamp of favorable radiant distribution which is similar to that of natural daylight radiation.

THE INVENTION

The present invention provides a sun lamp having an arc tube integrally mounted within a surrounding ultraviolet radiation transmissive envelope (bulb). The arc tube is a halogen metal vapor discharge lamp which contains mercury and at least one rare earth metal halide or iron halide. The arc tube is enclosed within a reflector envelope of special glass which has at 280 nm a spectral transmission factor of approximately zero, and at 300 nm of about 30%, and attains maximum transmittance above 350 nm. The reflctor bulb of the lamp is preferably designed as a paraboloid with flattened bowl. The arc tube is mounted within the envelope (bulb) with its longitudinal axis coincident with the longitudinal axis of the bulb. The arc tube is positioned between the base and the largest diameter of the reflector bulb so that the arc discharge extends from the focus of the paraboloidal portion approximately rearwards, i.e. remote from the bulb bowl. Alternately, however, other arrangements of the arc tube relative to the surrounding bulb are feasible.

The arc tube fill may contain iron, tin, mercury, mercury halide and argon as the starting gas, and preferably contains one or more rare earth metals such as holmium or thulium and preferably dysprosium; and mercury, mercury halide, thallium halide, cesium halide, and argon as the starting gas.

The Table set forth on the following page reports, for different light sources, the intensity of illumination as well as the radiation component in the respective UV-A, UV-B and UV-C regions. It also reports the times of exposure to attain the biological threshold dose for specified biological effects. Sources 1 and 2 are known radiation sources.

1. A mercury arc tube mounted in a bulb of hard glass.
2. A halogen metal vapor arc tube (with dysprosium halide fill) in a closely surrounding outer bulb of quartz glass mounted in a special lighting fixture provided with commercially available closure glass.

Radiation from the foregoing are compared with those of the radiation sources according to the invention.

3. A halogen metal vapor arc tube (with dysprosium halide fill) mounted in a reflector bulb.
4. A halogen metal vapor arc tube (with iron halide fill) mounted in a reflector bulb.

Table

| Radiation Source | Intensity of illumination at a distance of 1 m in lux | Irradiance at a distance of 1 m in mW/m² | | | Irradiance at a distance of 1 m in % (UV—B=100%) | | Required times of exposure in minutes at a distance of 1 m for attaining the threshold dose for | | |
|---|---|---|---|---|---|---|---|---|---|
| | | UV-C | UV-B | UV-A | UV-C | UV-A | conjunctivitis | erythema | pigmentation |
| 1. Hg arc tube with a bulb of hard glass (300 W) | 3100 | 14 | 1860 | 3800 | 0.75 | 205 | 40 | 9 | 400 |
| 2. Halogen metal vapor arc tube with quartz bulb in a special lighting fixture (250 W) | 9300 | 50 | 590 | 6500 | 8.5 | 1100 | 16 | 20 | 247 |
| 3. Halogen metal vapor arc tube with rare earth metal(s) fill in a reflector | 9300 | 7.4 | 600 | 7000 | 1.2 | 1150 | 55 | 23 | 230 |

Table-continued

| Radiation Source | Intensity of illumination at a distance of 1 m in lux | Irradiance at a distance of 1 m in mW/m² | | | Irradiance at a distance of 1 m in % (UV-B=100%) | | Required times of exposure in minutes at a distance of 1 m for attaining the threshold dose for | | |
|---|---|---|---|---|---|---|---|---|---|
| | | UV-C | UV-B | UV-A | UV-C | UV-A | conjunctivitis | erythema | pigmentation |
| bulb (250 W) | | | | | | | | | |
| 4. Halogen metal vapor arc tube with Fe-fill in a reflector bulb (250 W) | 3100 | 2.5 | 575 | 5800 | 0.43 | 1010 | 109 | 22 | 273 |
| 5. Natural Light* | 20000 | — | 650 | 7200 | — | 1100 | — | 21 | 225 |

*for comparison, values of natural light at 20,000 lux

The foregoing are also compared with No. 5, the radiant distribution of the ulraviolet component of natural radiation (Davos, Switzerland summer, noon, clear) at a predetermined intensity of illumination (20,000 lux).

The radiation sources (sun lamps) of the invention have an excellent radiant light distribution. The ratio of irradiance of UV-A to UV-B is substantially similar to that of natural radiation (sunlight). The radiation in the UV-C region is so small as to be harmless. Compared with the mercury arc tube mounted in a bulb of hard glass (No. 1), the radiation sources of the present invention have a much higher UV-A component and, compared with the halogen metal vapor arc tube encompassed by a closely fitting outer envelope of quartz glass mounted in a special lighting fixture (No. 2), the objectionable UV-C component of radiation is noticeably reduced.

The aforesaid advantages of the sun lamps of the present invention are further established from the times of exposure reported in the right hand column of the Table for attaining the threshold dosage for each of three specific biological responses. It is apparent that it is desirable to have the maximum time to reach the threshold value for conjunctivitis, and particularly more time than is required to reach the threshold value for the development of erythema. On the other hand, the time of exposure for attaining pigmentation should not exceed a certain period, considering practical application. The data given in the Table apply to direct pigmentation, i.e. pigmentaton without preceding development of erythema. If development of erythema occurs, then the time until reaching the threshold value for pigmentation is reduced. The data in the Table show that the threshold dose for both, development of erythema and pigmentation by means of the sun (irradiation) lamps in accordance with the invention, is attained with 9,300 lux or 3,100 lux (at a distance of 1 m) after the same times of exposure as in case of natural radiation with 20,000 lux. With radiation source No. 1, the development of erythema is already attained within a shorter period of time, and substantially longer periods of time are required for pigmentation. With radiation source No. 2, conjunctivitis occurs after a shorter period of time than development of erythema, so that during exposure to the said radiation source an eyeshield is required.

Apart from the aforesaid advantages of the sun (irradiation) lamps of the present invention it should be noted that in particular the lamp No. 3 emits in addition light which resembles solar radiation.

THE DRAWINGS

The FIGURE is a schematic view of an embodiment of the invention.

The tubular arc tube 1 of quartz glass with an inner diameter of 15–16 mm is provided at each end with an electrode 2, 3, respectively, of activated refractory metal such as, e.g., thorium oxide-activated tungsten. These electrodes 2, 3 are connected to the lead-in wires 4, 5 across foil seals. The electrode spacing is 25 mm. The end portions of arc tube 1 are externally provided with a heat reflective coating 6 of, e.g., zirconium dioxide. The arc tube 1 is secured and mounted within bulb 7 by the lead-in wires 4, 5. The bulb (including glass envelope) 7 is composed of special glass and is provided with a reflector 8 and a screw base 9. Reflector 8 on the inner wall surface of the paraboloidal bulb portion comprises a layer of aluminum. The transmittance of the special glass in the direction of emission at the flattened bulb bowl is approximately zero at 280 nm, and about 30% at 300 nm. The maximum transmittance of the glass is attained above 350 nm.

The arc tube fill comprises (a) 1 mg dysprosium, 4 mg $HgI_2$, 1 mg thallium iodide, 1 mg cesium iodide, 10 mg mercury, and argon at 30 torr; or (b) 0.3 mg iron, 0.1 mg tin, 3.2 mg $HgI_2$, 17 mg mercury, and argon at 30 torr. The wattage input of the arc tube is 240 W and the amperage about 3 A; the operating voltage is about 90 V.

The preferred special glass used for the bulb is known commercially as Corning 7760 glass.

I claim:

1. A sun lamp comprising an arc tube integrally mounted within a surrounding ultraviolet transmissive envelope, said arc tube comprises a halogen metal vapor discharge lamp containing mercury and (i) at least one rare earth metal halide or (ii) iron halide; said ultraviolet light transmissive envelope comprising glass having a spectral transmission factor of approximately zero at 280 nm, of about 30% at 300 nm, and maximum transmittance being attained at above 350 nm, said sun lamp transmitting radiation having a ratio of UV-A to UV-B substantially the same as sunlight with the radiation in the UV-C region being so small as to be harmless.

2. The sun lamp of claim 1 wherein said envelope is shaped and only partially covered with a reflective metal layer to form a reflective bulb transmitting ultraviolet light through the portion of the envelope not covered by said reflective metal layer.

3. The sun lamp of claim 1, wherein the fill of the arc tube comprises mercury, at least one rare earth metal, mercury halide, thallium halide, cessium halide and argon.

4. The sun lamp of claim 1, wherein the fill of the arc tube comprises mercury, iron, tin, mercury halide and argon.

5. The sun lamp of claim 2, wherein said reflector bulb is shaped as a paraboloid with a flattened bowl comprising the ultraviolet light transmissive portion of said envelope.

6. The sun lamp of claim 2, wherein the longitudinal axis of the arc tube is coincident with the longitudinal axis of the reflector bulb.

7. The sun lamp of claim 6, wherein the arc tube is mounted in the reflector bulb and positioned between the base and the largest diameter of the reflector bulb.

8. The sun lamp of claim 5, wherein the fill of the arc tube comprises mercury, at least one rare earth metal, mercury halide, thallium halide, cesium halide and argon.

9. The sun lamp of claim 7, wherein the fill of the arc tube comprises mercury, at least one rare earth metal, mercury halide, thallium halide, cesium halide and argon.

10. The sun lamp of claim 5, wherein the fill of the arc tube comprises mercury, iron, tin, mercury halide and argon.

* * * * *